US007308933B1

(12) United States Patent
Mayfield et al.

(10) Patent No.: US 7,308,933 B1
(45) Date of Patent: Dec. 18, 2007

(54) POWER ASSISTED LIFT FOR LUBRICATOR ASSEMBLY

(75) Inventors: Windel O. Mayfield, Brownwood, TX (US); Robert L. Moore, Weatherford, TX (US)

(73) Assignee: PAAL, L.L.C., Oklahoma City, OK (US)

( * ) Notice: Subject to any disclaimer, the term of this patent is extended or adjusted under 35 U.S.C. 154(b) by 308 days.

(21) Appl. No.: 10/985,369

(22) Filed: Nov. 10, 2004

(51) Int. Cl.
*E21B 19/00* (2006.01)

(52) U.S. Cl. ..... 166/85.1; 166/92.1; 166/70; 166/77.51

(58) Field of Classification Search ..... 166/52, 166/84.2, 70, 92.1, 75.11, 77.1, 85.1, 85.5; 414/22.58, 22.54
See application file for complete search history.

(56) References Cited

U.S. PATENT DOCUMENTS 4,423,774 A * 1/1984 Mefford ..... 166/77.51
6,827,147 B2 * 12/2004 Dallas ..... 166/379
2005/0061548 A1 * 3/2005 Hooper et al. ..... 175/52

* cited by examiner

*Primary Examiner*—David Bagnell
*Assistant Examiner*—Brad Harcourt
(74) *Attorney, Agent, or Firm*—Fellers, Snider, Blankenship, Bailey & Tippens, P.C.; Dennis D. Brown

(57) ABSTRACT

An improved lubricator assembly for receiving a well plunger or other downhole tool wherein a hinge is connected between a lower portion and an upper riser of the lubricator assembly and a power lifting device is included for moving the upper riser off of and onto the lower portion of the lubricator assembly.

5 Claims, 2 Drawing Sheets

POWER ASSISTED LIFT FOR LUBRICATOR ASSEMBLY

FIELD OF THE INVENTION

The present invention relates to lubricator assemblies for well plungers and other downhole tools.

BACKGROUND OF THE INVENTION

Plungers have been used heretofore for lifting, recovering, and/or removing oil, water, or other fluids from well casings and other tubulars. In some wells, due to relatively low formation pressures and/or other formation conditions, liquids tend to accumulate at some level within the well casing rather than flowing naturally to the surface. Plungers offer potential benefits over conventional pumps, submersible pumps, and other power-operated devices for recovering or removing such fluids.

Various types of plunger devices are known in the art. By way of example, one common type of plunger comprises: an elongate housing assembly; one or more external sealing devices which can be actuated to sealingly contact the interior wall of the well casing; a flow passage extending through the housing assembly; and a valve for opening and closing the flow passage.

When using a well plunger, a lubricator assembly is typically installed above ground at the wellhead for receiving and retaining the plunger between production cycles. At the beginning of the production cycle, the plunger is dropped from the lubricator assembly with the plunger valve in open position. The fluid in the well casing or tubular is thus allowed to flow through the interior flow passage so that the plunger will drop through the fluid to a stop structure installed at a desired downhole position.

The plunger will typically be configured such that, upon striking the downhole stop structure, the plunger valve will automatically close and the external seal(s) will be urged into contact with the interior wall of the tubular. With the tubular sealed in this manner, the pressure beneath the plunger will eventually increase to the point that the plunger will begin to rise, thus lifting the column of fluid on top of the plunger toward the surface and into an overhead production line.

Upon reaching the top of the well, the plunger is again received in the lubricator assembly. The lubricator assembly will typically include an interior actuator which automatically operates to open the plunger valve and release or retract the plunger seal(s). The lubricator assembly will also typically include an interior latch mechanism which will releasably grasp and hold the plunger at the top of the well until it is time to drop the plunger into the well for another production cycle.

The lubricator assembly will typically comprise (a) a lower portion such as an adapter which is installed on the well casing or other tubular above ground at the well head and (b) an upper riser which is removably installed on the upper end of the adapter. The upper riser can be detached from the adapter for removing, servicing, and/or replacing the plunger.

The lubricator assemblies used heretofore for plungers and other downhole tools have had significant shortcomings. The riser segment of a typical lubricator assembly can weigh in the range of from about 50 to about 350 pounds. Thus, the removal, lifting, alignment, and reattachment of the riser can be very difficult and hazardous and often requires the use of a hoist or other lifting device which must be transported to the well site. To assist in handling the riser, it has been suggested that a hinge be installed between the adapter and the riser. However, even with the use of a hinge, the weight and size of the riser element is typically such that it is still difficult to lift the riser off of and on to the adapter and to hold the riser in precise alignment for reattachment.

SUMMARY OF THE INVENTION

The present invention satisfies the needs and alleviates the problems discussed above. The present invention provides an improved lubricator assembly for receiving a well plunger or other downhole tool. The lubricator assembly includes: a lower portion; an upper riser removably attachable to the lower portion; and a hinge connected between the lower portion and the upper riser for hingedly moving the riser onto and off of the lower portion. The improvement comprises a power lifting device connected between a first portion of the hinge attached to the lower portion of the lubricator assembly and a second portion of the hinge attached to the upper riser.

Further aspects, features, and advantages of the present invention will be apparent to those skilled in the art upon examining the accompanying drawings and upon reading the following Detailed Description of the Preferred Embodiments.

DETAILED DESCRIPTION OF THE PREFERRED EMBODIMENTS

Figure 1:
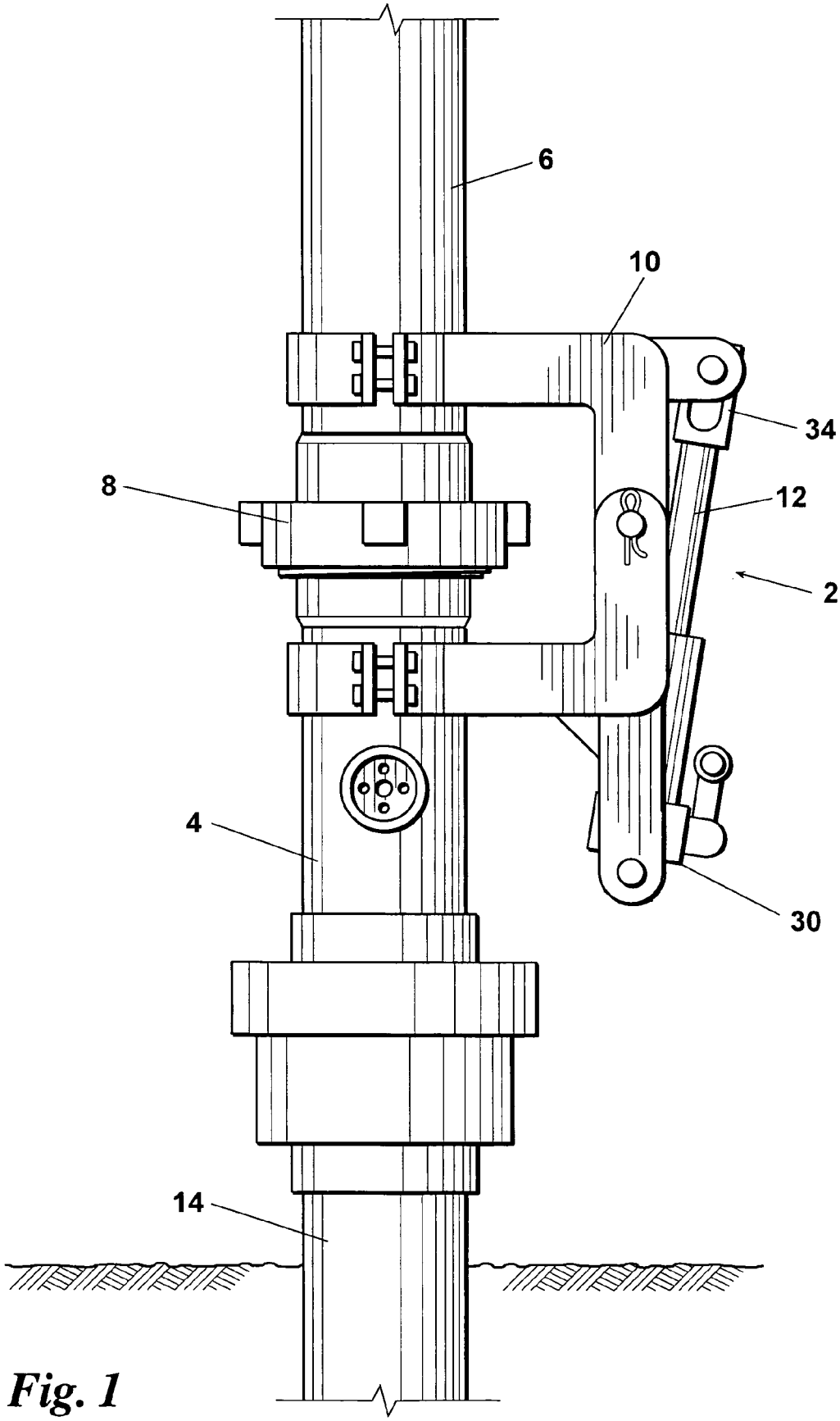
FIG. 1 is an elevational view of an embodiment 2 of the inventive lubricator assembly in closed position.
Figure 2:
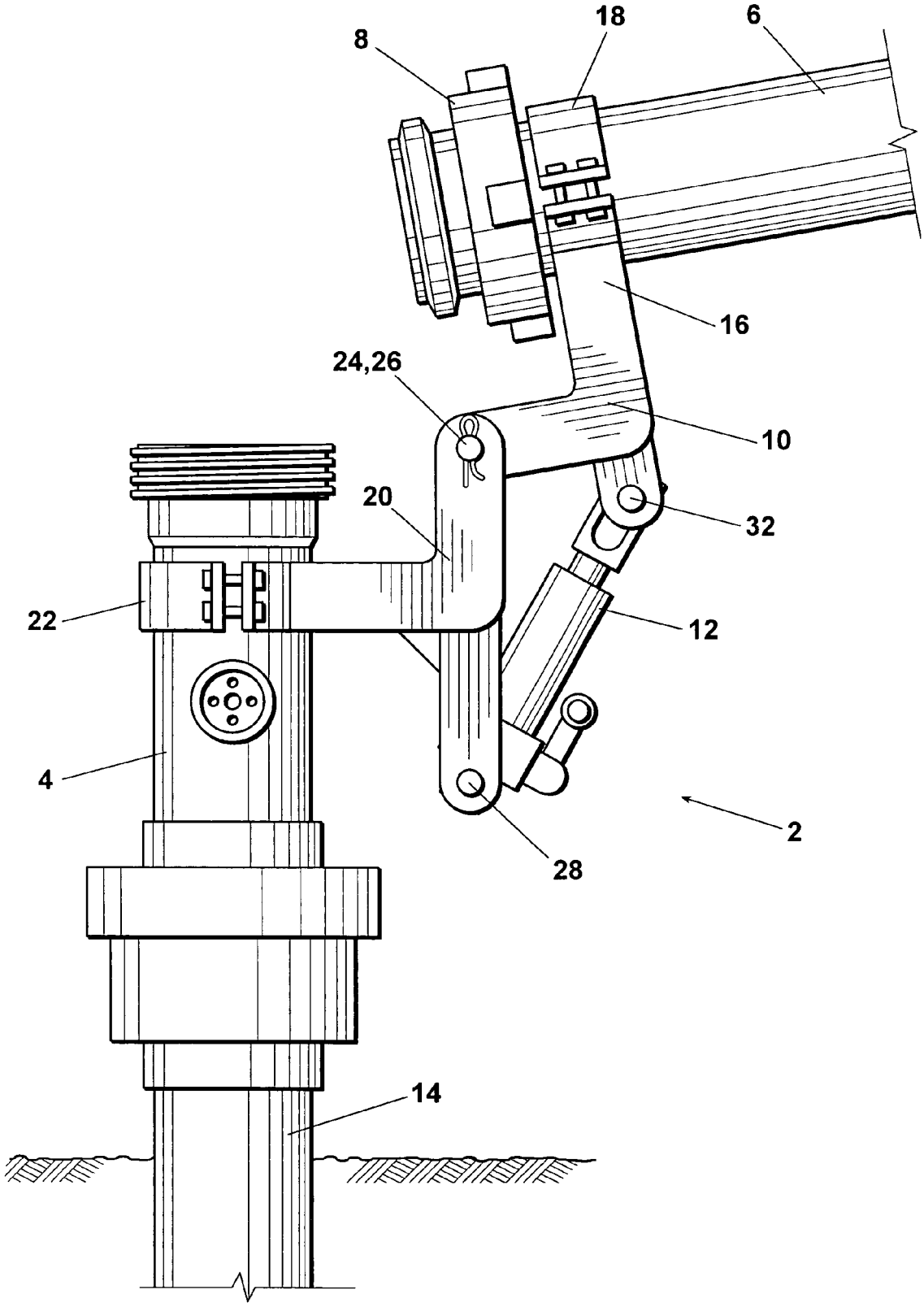
FIG. 2 is an elevational view of the inventive lubricator assembly 2 in open position.

An embodiment 2 of the inventive lubricator assembly is depicted in FIGS. 1 and 2. As used herein and in the claims, the term "lubricator" refers to any device positionable above ground for receiving a well plunger or other downhole tool. The inventive lubricator 2 comprises: a lower portion 4; an upper riser 6 removably positionable on the upper end of lower portion 4; a threaded coupling 8 or other device for securing upper riser 6 on lower portion 4; a hinge structure 10 connected between upper riser 6 and lower portion 4; and a power lifting device 12 for lifting the upper riser 6 onto and off of the lower portion 4. In embodiment 2, the lower portion 4 is an adapter which is secured on the upper end of a well casing or other tubular 14. However, it will be understood that the lower portion 4 could simply be the upper end of the casing or tubular 14 itself.

The hinge 10 comprises: a top portion 16 having a bracket assembly 18 for attachment to the upper riser 6; a bottom portion 20 having a bracket assembly 22 for attachment to the lower portion 4; a pivot point or axis 24 where the top portion 16 is pivotably attached to the bottom portion 20 using a pivot pin, rod, or other structure 26; a lower brace structure 28 projecting downwardly from the bottom portion 20 for attaching the lower end 30 of the power lifting device 12; and an upper brace structure 32 projecting outwardly from the top portion 16 for attaching the upper end 34 of the power lifting device 12. Although the hinge 10 can have multiple pivot points, the hinge will preferably have only a single horizontal pivot point or axis 24 as illustrated in FIGS. 1 and 2.

It will be understood by those in the art that, rather than using bracket assemblies 18 and 22, other approaches can be used for attaching the top portion 16 and/or the bottom portion 20 of hinge 10 to the lubricator 2. For example, the top and/or bottom portions of the hinge 10 can be connected to the lubricator 2 by welding.

The power lifting device 12 can be any device known in the art capable of pivoting or rotating the upper riser 6 on hinge 10 toward and away from the lower portion 4. Examples of suitable power lifting devices 12 include but are not limited to hydraulic, mechanical, pneumatic, electric, or other types of jacks, piston and cylinder assemblies, rack and pinion assemblies, or worm gear and drive assemblies. The power lifting device 12 will preferably be hand-operated. The power lifting device 12 is preferably a jack and is most preferably a hydraulic jack.

The power lifting device 12 can be removably or permanently installed between the top portion 16 and the bottom portion 20 of hinge 10. The power lifting device 12 will preferably be removably installed to facilitate replacement and repair and/or to allow the power lifting device 12 to be conveniently transported from site to site to prevent theft and to reduce costs.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. In a lubricator assembly for receiving a well plunger from a well tubular, said lubricator assembly including a lower portion, an upper riser removably attachable to said lower portion for removing said well plunger from said lubricator assembly, and a hinge assembly, said hinge assembly including a first portion of said hinge assembly connected to said lower portion of said lubricator assembly, a second portion of said hinge assembly connected to said upper riser, and at least one hinge pin or rod connecting said second portion of said hinge assembly to said first portion of said hinge assembly for hingedly moving said upper riser onto and off of said lower portion of said lubricator assembly, comprising a power lifting device connected between (a) said first portion of said hinge assembly connected to said lower portion of said lubricator assembly and (b) said second portion of said hinge assembly connected to said upper riser.

2. The lubricator assembly of claim 1 wherein the improvement further comprises said power lifting device being a jack.

3. The lubricator assembly of claim 1 wherein the improvement further comprises said power lifting device being a hand-operated jack.

4. The lubricator assembly of claim 1 wherein the improvement further comprises said power lifting device being a hydraulic jack.

5. The lubricator assembly of claim 1 wherein the improvement further comprises said hinge assembly having a single axis of rotation.

* * * * *